US007997453B1

(12) United States Patent
Gallegos

(10) Patent No.: US 7,997,453 B1
(45) Date of Patent: Aug. 16, 2011

(54) FLUID PUMPING DISPENSER

(76) Inventor: Yuri Gallegos, Plainfield, IL (US)

( * ) Notice: Subject to any disclaimer, the term of this patent is extended or adjusted under 35 U.S.C. 154(b) by 426 days.

(21) Appl. No.: 11/775,187

(22) Filed: Jul. 9, 2007

Related U.S. Application Data

(60) Provisional application No. 60/806,787, filed on Jul. 9, 2006.

(51) Int. Cl.
*B65D 83/76* (2006.01)

(52) U.S. Cl. ..... 222/207; 222/213; 222/518; 222/496

(58) Field of Classification Search ..... 222/207, 222/209, 518, 494–496, 212, 213
See application file for complete search history.

(56) References Cited

U.S. PATENT DOCUMENTS 936,186 A * 10/1909 Tellerson ..... 222/213
2,908,423 A * 10/1959 Bross ..... 222/213
2,984,393 A * 5/1961 Magnenat ..... 222/501
3,087,656 A * 4/1963 Dougherty ..... 222/518
3,107,035 A * 10/1963 Bertram ..... 222/213
3,154,222 A * 10/1964 Heckman ..... 222/213
3,739,827 A * 6/1973 Sondel ..... 220/495.06
3,902,815 A * 9/1975 Williams ..... 401/264
4,394,939 A * 7/1983 Thor et al. ..... 222/207
4,457,453 A * 7/1984 Stevens et al. ..... 222/48
4,651,904 A * 3/1987 Schuckmann ..... 222/383.1
4,991,749 A * 2/1991 Kay et al. ..... 222/384
5,044,523 A * 9/1991 McNab ..... 222/207
5,377,880 A * 1/1995 Moretti ..... 222/207
5,857,595 A * 1/1999 Nilson ..... 222/212
5,862,955 A * 1/1999 Albini et al. ..... 222/212
5,971,224 A * 10/1999 Garibaldi ..... 222/207
6,109,484 A * 8/2000 Sueoka et al. ..... 222/390
6,789,706 B2 * 9/2004 Abergel et al. ..... 222/207
6,971,553 B2 * 12/2005 Brennan et al. ..... 222/207

* cited by examiner

*Primary Examiner* — Kevin P Shaver
*Assistant Examiner* — Donnell Long

(57) ABSTRACT

A fluid-pumping-dispenser that is composed of a pump-tube of tubular shape, and provided on one end of a plug to close and open an outlet from a container. The other side of the pump-tube is mounted on either a housing with a valve-rod, or a front-valve with an adapter will prevent the fluid from returning back to the pump-tube. To provide the power an actuator is provided that will pinch the pump-tube, and will the help of the valves described will pump fluids from a container through the pump-tube and to the outside by the nozzle on the housing. To complete the assembly a container is provided with a piston to store the fluid.

2 Claims, 8 Drawing Sheets

FLUID PUMPING DISPENSER

CROSS-REFERENCE TO RELATED APPLICATIONS

This application claims the benefit of PPA Ser. No. 60/806,787, filed Jul. 9, 2006 by the present inventor.

FEDERALLY SPONSORED RESEARCH

None.

SEQUENCE LISTING

None.

BACKGROUND OF THE INVENTION

1. Field of Invention

This invention generally relates to a dispenser for fluids that will need some pumping action to let the fluid inside a container exit without difficulty, but at the same time will impede the entrance of other substances like air, water and dirt into the container and pump.

2. Prior Art

Previously all dispensers were made using expensive springs, ball metallic valves, and some kind of piston system or propellants to pump the fluid from a container to the exterior using an actuator that the user needs to press in order to activate pumping action. Included in these devices are aerosols that are often used by normal people for cosmetic and medical applications. These devices are consumed in big quantities and are becoming a problem because they take up space in landfills and because the propellants that are used on them are affecting climate change and are responsible for some greenhouse emissions. Many countries still allow these propellants to be used, including the U.S. (e.g. propellant 134A banned in Europe but permitted in the U.S.). According to the U.S. government they will be eliminated in the next 10 to 15 years. Many of the components used in these devices are metallic, e.g., aluminum, steel, chrome, lead. Some of these metals, such as aluminum and steel, can be recycled. However, others are harder and contaminate the environment, such as chrome and lead.

The use of current aerosol dispensing devices cannot continue and new devices that provide the same function and are recyclable should be developed. One of the problems is to keep the product inside these devices from getting contaminated, a task that is easily accomplished when using an aerosol. For the reasons detailed above, aerosols will be off the market one day. This is the reason why we need to find other ways to dispense fluid or fluid like substances well from a device that is cheaper, recyclable and will not harm the atmosphere with its emissions when put in the trash.

Some of the new dispensers are more environmentally-friendly but will leave the fluid inside the pump open to any kind of contamination getting inside the container. Some inventors have started to solve this problem, adding a closeable lid that the user must insert on the nozzle to close and to prevent any extraneous fluids or particle(s) from entering inside the pump and container. Sometimes this works well enough. However, in some cases, such as creams that can easily get oxidized with air and reduce their potency, this situation becomes critical. At the same time, some fluids used in medical applications need to stay clean and free of contaminants to be safe to use for human applications. All the dispensers heretofore known in the market suffer from a number of disadvantages:

(a) All dispensers currently available in the market allow air to enter in the pump and container. This can result in oxidation of the substance inside the container. The substance will get damaged or change its properties over time. An example would be an anti-age cream with certain vitamins that in contact with air will change color, thicken and oxidize, losing their anti-aging properties. Another example is a cream that helps to heal scars, but is not effective if put into contact with oxygen. These creams are usually very expensive.

(b) On a normal dispenser, any contaminants coming from the exterior can enter the container through the pump, contaminating and damaging the formula of a medical product. This is especially critical in medical applications where bacteria or other microorganisms can enter the container and grow inside. Later the patient who is taking this formula can get infected by the bacteria or other microorganisms. This can happen to patients with a low immune system, who can die from an airborne disease coming from the container that has the medicine that is supposed to cure them, not infect them.

(c) The dispenser needs to have the nozzle closed with a lid to prevent any contaminant from entering the container. Sometimes people do not like to close the nozzle, forget or do not have time to do it. For example, when dispensing a diaper rash cream, if the baby moves around all the time, it is easy to forget to close the cream while putting a diaper on the baby after using the cream.

(d) Using a dispenser for many applications create a large amount of trash when the dispenser is discarded after the product inside is used. This is especially noticeable when these devices are used for cosmetic and especially medical applications where they are mass-produced. These devices cannot be degraded or recycled easily, creating a problem for the environment.

(e) Current dispensers are more expensive and use expensive components as steel springs and expensive plastics to work properly.

3. Object and Advantages

Accordingly several objects and advantages of the invention are:

(a) To provide a dispenser that will pump and act as a check valve when dispensing the product inside. The dispenser allows the product; usually a fluid or cream, to exit, but at the same time does not permit the entrance of air, water, bacteria, microorganisms, dirt and other undesirable substances inside the container.

(b) To provide a dispenser that can dispense a metered amount of fluid that can be useful for certain medical applications where dispensing a dose is critical.

(c) To provide a dispenser that seals itself, so that no harm will come to the contents of the container if the device is in a dirty environment.

(d) To provide a dispenser that can easily be injection molded and manufactured very easily, with only a few components.

(e) This dispenser can be made of plastics like polypropylene, polyethylene, and thermoplastics elastomers like Santoprene™ materials that are easily recyclable.

(f) To provide a dispenser that can be set ready to dispense with just one push and that will close automatically to prevent any spill.

Further objects and advantages will become apparent from a consideration of the ensuring description and drawings.

SUMMARY

In accordance with the present invention, a dispenser for dispensing fluids comprises a rubber tube that has a check valve on each end and is mounted on a case with an actuator. On the other side there will be a container and a piston. The dispenser will dispense only when the actuator is pressed, causing the fluid to exit. When the desired amount of fluid has exited, it will automatically close to prevent any air or other substances from entering the container and pump. A piston will automatically move forward, compensating for the volume being dispensed.

DRAWINGS

Figures

In the drawings, closely related figures have the same number but different alphabetic suffixes.

DRAWINGS

Reference Numerals

1 Fluid pumping device.
2 Fluid pumping device second embodiment.
10 Pump-tube.
12 Pump-reservoir.
14 Plug.
16 Rib.
18 Cavity.
20 Housing.
22 Nozzle.
24 Housing-groove.
26 Cutout.
28 Housing-opening.
30 Valve-rod.
32 Bevel.
34 Rod.
40 Actuator.
42 Catch.
44 Seat.
50 Container.
51 Outlet.
52 Slant.
54 Channel.
56 Container-body.
58 Container-opening.
60 Piston.
62 Wall.
64 Lip.
80 Front-valve.
82 Valve-disc.
84 Cone.
86 Discharge.
90 Adapter.
92 Adapter-disc.
94 Shoulder.
96 Orifices.
100 Pump-fluid.
110 Storage-fluid.

DETAILED DESCRIPTION

Preferred Embodiment

FIGS. 1, 2A, 2B, 3, 4, 5, 6, 7, 8, 9, 10, 11, 12 and 13

Figure 1:
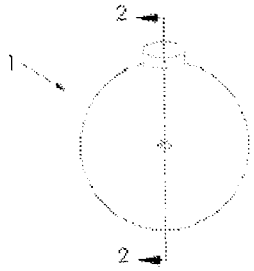
FIG. 1 is a plan view of my invention.
Figure 2A:
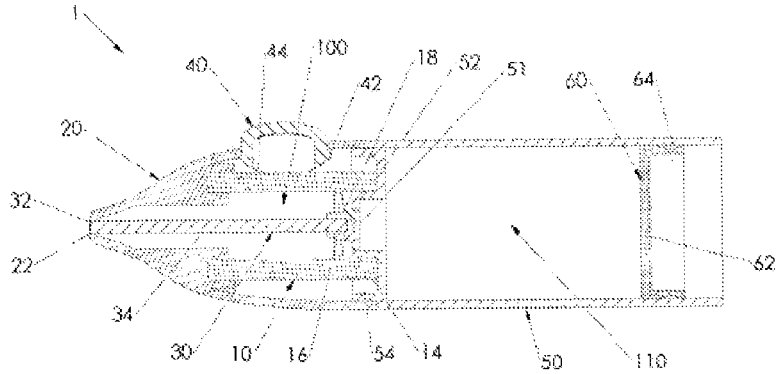
FIG. 2A is a cross-sectional view of the dispenser taken from line 2-2 in FIG. 1.
Figure 13:
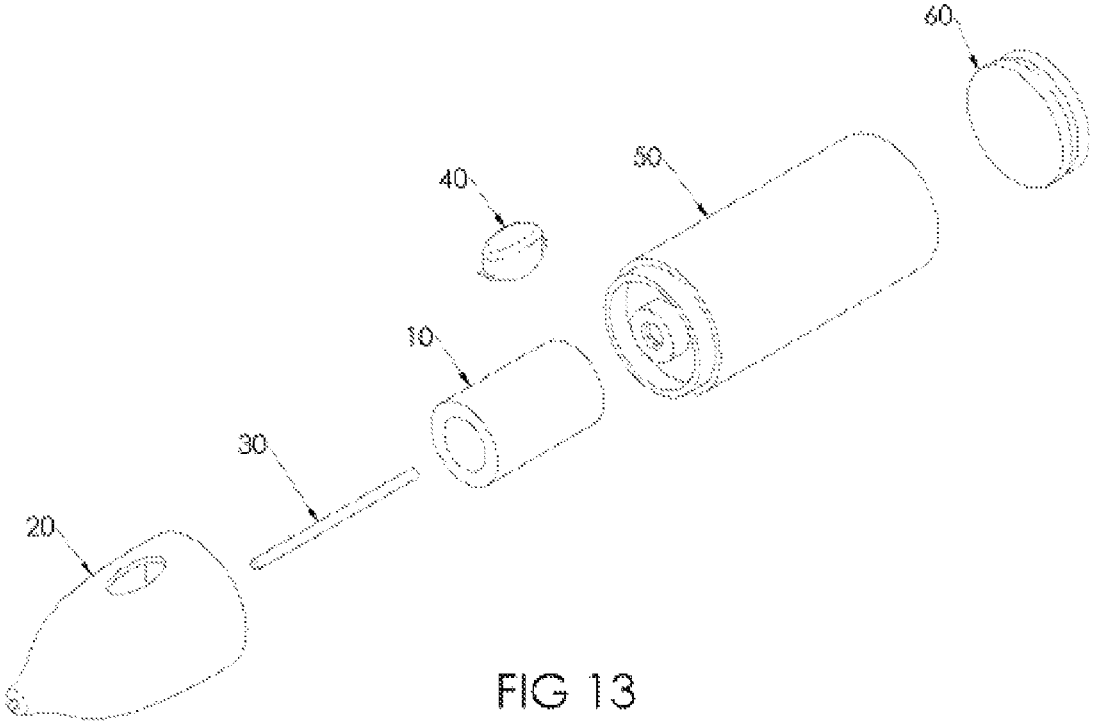
FIG. 13 is an exploded view of my invention.
Figure 14:
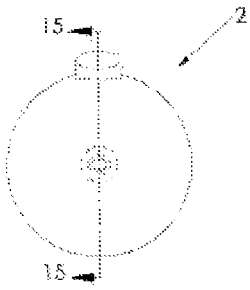
FIG. 14 is a plan view of the dispenser of a second embodiment.
Figure 15A:
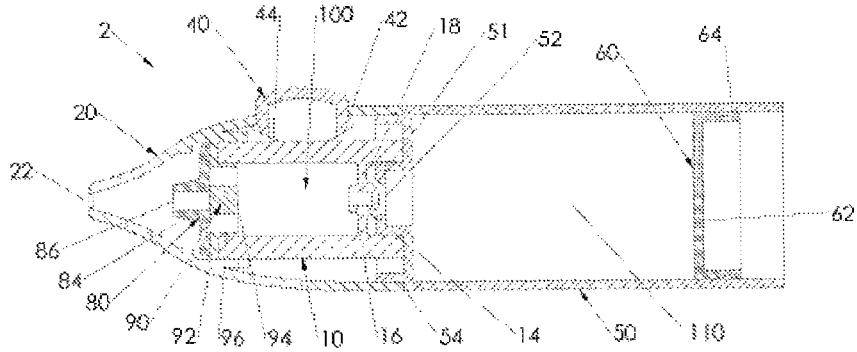
FIG. 15A is a cross-sectional view of a second embodiment of my invention taken from line 15-15 in FIG. 14.
Figure 15B:
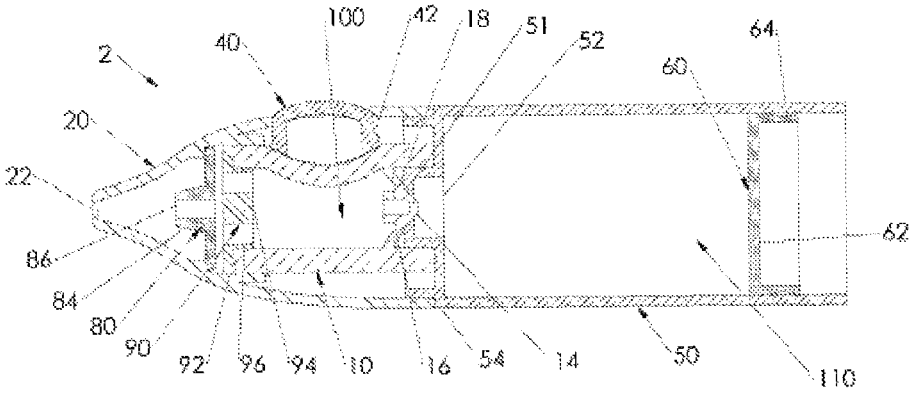
FIG. 15B is a cross-sectional view of a second embodiment of my invention taken from line 15-15 in FIG. 14.
Figure 16:
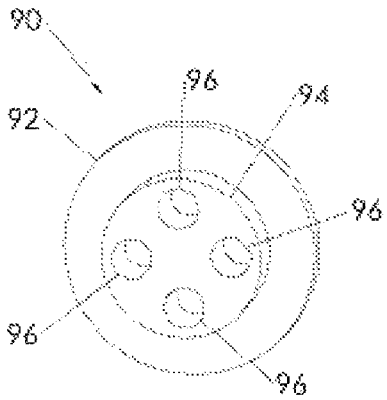
FIG. 16 is an isometric view of the adapter of a second embodiment.
Figure 17:
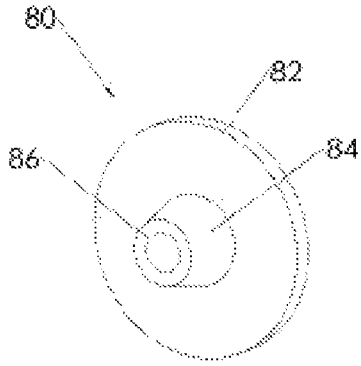
FIG. 17 is an isometric view of the front-valve of a second embodiment of my invention.
Figure 18:
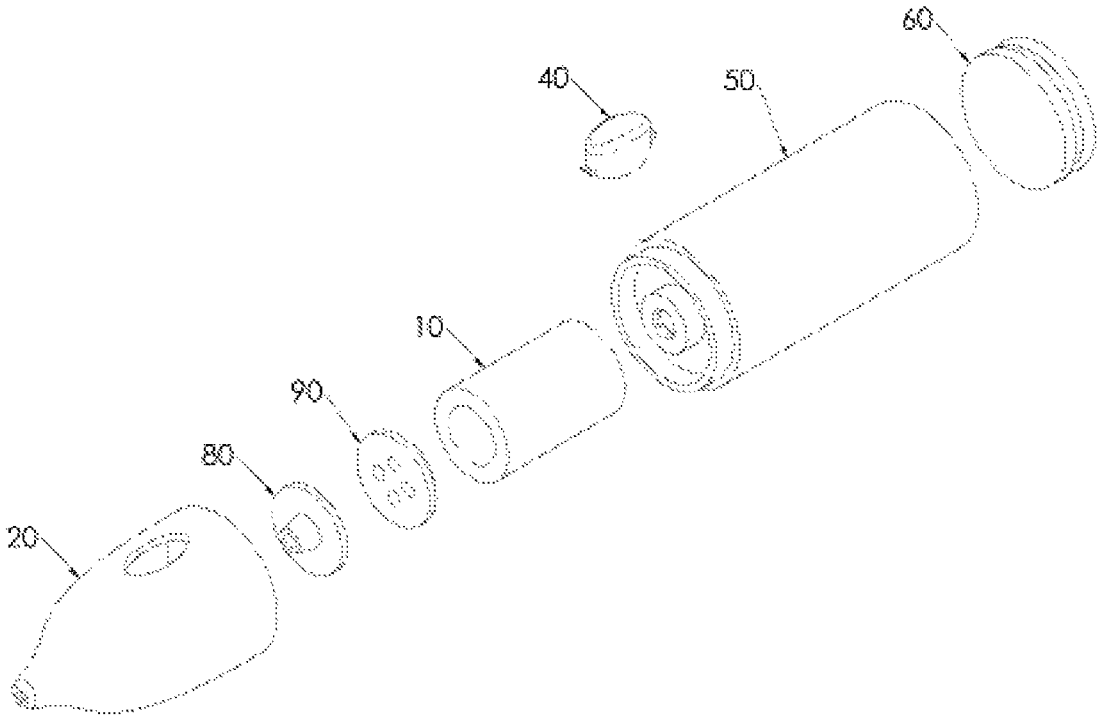
FIG. 18 is an exploded view of a second embodiment of my invention.

A preferred embodiment of the dispenser of the present invention is illustrated in FIG. 2A, which is a cross-sectional view taken at line 2-2 in FIG. 1 of my invention, and gives an interior view of how the components are arranged. While this is my preferred embodiment, many alternative embodiments are possible, and the specificities listed below should not be construed as limiting the scope of the invention, but merely as providing illustrations of the preferred embodiment. FIG. 13 shows an exploded view of my invention.

Figure 4:
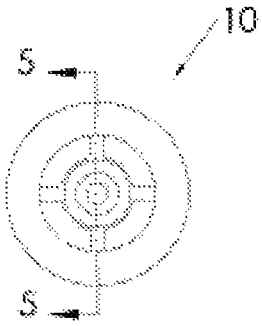
FIG. 4 is a plan view of the pump-tube.
Figure 5:
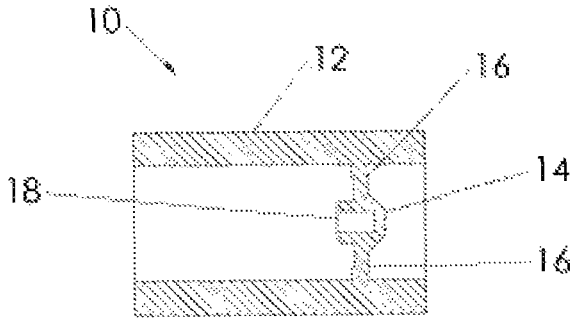
FIG. 5 is a cross-sectional view of the pump-tube taken from line 5-5 in FIG. 4.

The pump-tube 10 on FIGS. 4 and 5 is composed of a pump-reservoir 12 with a conical plug 14 that is hold in the center by a plurality of ribs 16. The plug 14 has in its back a cavity 18. The pump-tube 10 can be injected from a softer material, preferably but not limited to be of thermoplastic elastomer (TPE), and preferably the one provided by the brand Santoprene™. The size of the pump-tube 10 is based on the standard dispensers that can be found on the market, although many other sizes or shapes could be used. For this figure a pump-tube 10 with a nominal diameter of 12 mm was chosen.

Figure 6:
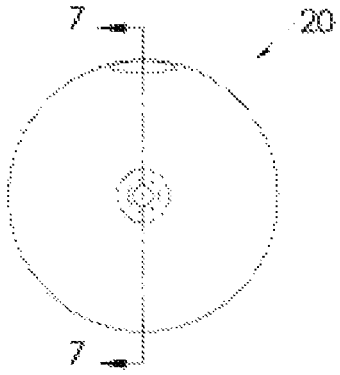
FIG. 6 is a plan view of the housing.
Figure 7:
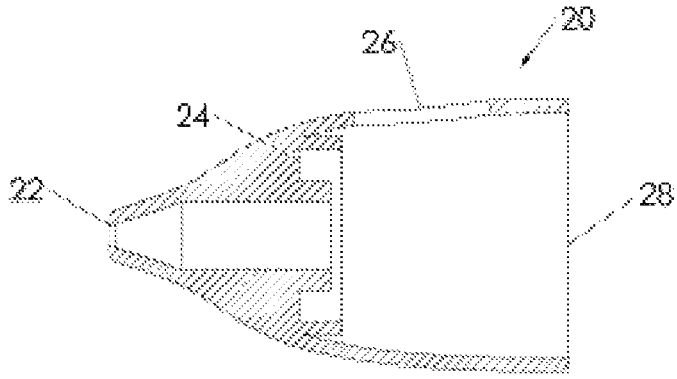
FIG. 7 is a section view of the housing taken from line 7-7 in FIG. 6.

The housing 20 shown in FIGS. 6 and 7 has a cutout 26 on top to fit the actuator 40. FIG. 7 shows a cross-sectional view taken from FIG. 6 at line 7-7 that shows the cutout 26 has a housing-groove 24 and a nozzle 22. On one side there is a housing-opening 28. The housing 20 is made of injection molded plastic and preferably of polypropylene (PP), although a high density polyethylene (HDPE) can also be used.

Figure 8:
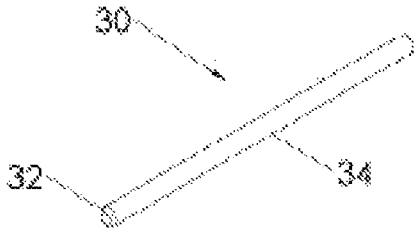
FIG. 8 is a perspective view of the valve-rod.

The valve-rod 30 shown in FIG. 8 is composed of a rod 34 that has a bevel 32 on one of its ends. The valve-rod 30 can be made of injection molded plastic and preferably of polypropylene (PP), although many other hard plastics can be used.

Figure 3:
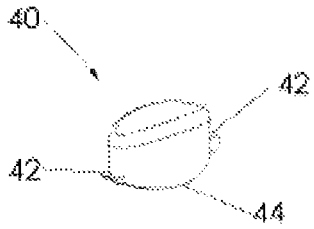
FIG. 3 is a perspective view of the actuator.

The actuator 40 shown in FIG. 3 can have almost any shape but basically is a seat 44 with caches 42 to keep it in place. The actuator 40 can be made of injection molded plastic and preferably polypropylene (PP) although many other hard plastics can also be used.

Figure 9:
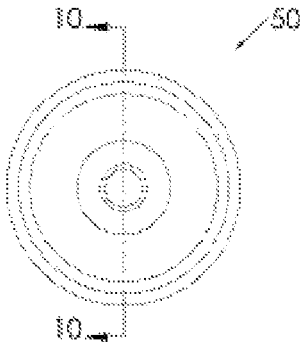
FIG. 9 is a plan view of the container.
Figure 10:
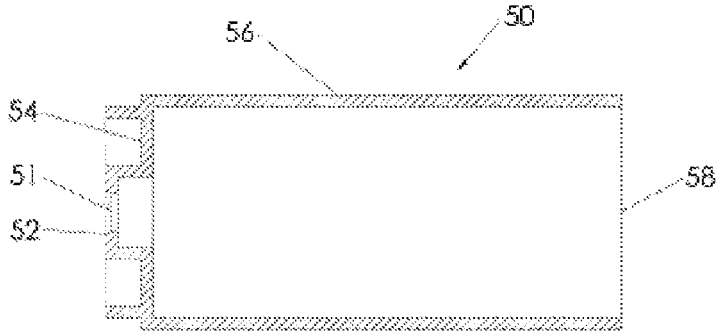
FIG. 10 is a cross-sectional view of the container taken from line 10-10 in FIG. 9.

The container 50 shown in FIG. 9 and a cross sectional view shown in FIG. 10 is made of a container-body 56. On one side, there is a circular channel 54 to mount the pump-tube 10. There is also an outlet 51 that has a slant 52 that matches the plug 14 from the pump-tube 10. The container 50 can be made of injection molded plastic and preferably polypropylene (PP) although many other hard plastics can also be used.

Figure 11:
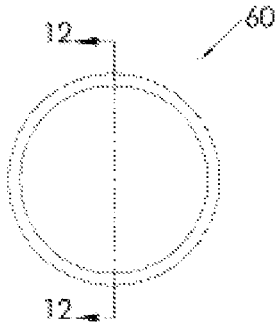
FIG. 11 is a plan view of the piston.
Figure 12:
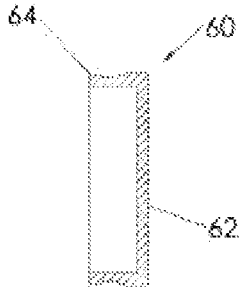
FIG. 12 is a cross-sectional view of the piston taken from line 12-12 in FIG. 11.

The piston 60 shown in FIG. 11 and a cross sectional view shown in FIG. 12 has a cylindrical shape where one side is covered by a wall 62. On one edge of the cylinder there is a lip 64. The piston 60 can be made of injection molded plastic and preferably polypropylene (PP) although many other hard plastics can also be used.

FIG. 13 shows the components of the invention in an exploded view showing the pump-tube 10, where the valve-rod 30 is mounted on the cavity 18 of the plug 14, the housing 20 completes the front. On the second part of the assembly the container 50 with a piston 60 finishes the design.

Operation

Preferred Embodiment

FIGS. 1, 2A, 2B

Figure 2B:
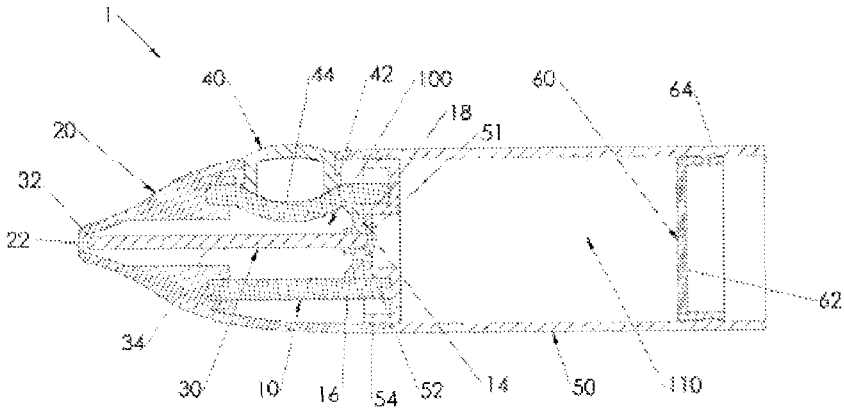
FIG. 2B is a cross-sectional view of dispenser taken from line 2-2 in FIG. 1.

In operation a person uses the fluid-pumping-dispenser in the following manner, see FIG. 2B. When the pump-tube 10 is pressed by the actuator 40, the pump-tube 10 deforms, reducing its inside volume. The pump-fluid 100 which cannot be compressed pushes the plug 14 against the container 50 closing the outlet 51. At the same time the valve-rod 30 that is attached to the plug 14 of the pump-tube 10 opens the nozzle 22 of the housing 20. At this point the fluid can only exit. Once the person releases the pressure on the actuator 40 (see FIG. 2A) the pump-tube 10 recovers its original position and the plug 14 of the pump-tube 10 returns to its normal position, making the valve-rod 30 close the nozzle 22 of the housing 20. When this happens the storage-fluid 110 is absorbed to the interior of the pump-tube 10 filling the space left by the fluid that was pumped during the first cycle of the operation. The piston 60 moves forward inside the container 50 to compensate for the volume dispensed during the first part of the cycle.

The valve-rod 30 is mounted on the cavity 18 of the plug 14 of the pump-tube 10 so they can move at the same time during the different cycles of operation.

The container 50 has an outlet 51 with a slant 52 that matches the profile of the plug 14 of the pump-tube 10 to close hermetically when put in contact.

The piston 60 has a lip 64 that touches the interior of the container 50 keeping the inside hermetically closed.

Description

Alternative Embodiment

FIGS. 14, 15A, 15B, 16, 17, 18

In this embodiment the fluid-pump-dispenser is using most of the components already described in the preferred embodiment but the valve-rod 30 is replaced by the combination of front-valve 80 and adapter 90.

The adapter 90 is composed of an adapter-disc 92 with a shoulder 94 that has a plurality of orifices 96. This component is made but not limited to plastic, but preferably polypropylene (PP).

The front-valve 80 has a valve-disc 82 where a cone 84 is located in the center; there is a discharge 86 that pass through the piece. This component is made but not limited to plastic, but preferably polypropylene (PP).

The operation of this embodiment is similar to the preferred embodiment already described with the exception that during the first cycle, the front-valve 80 moves forward after being pushed by the pump-fluid 100 when the actuator 10 pinch the pump-tube 10, resulting in the opening of the orifices 96 of the adapter 90. The pump-fluid 100 then can exit to the exterior through the orifices 96 of the adapter 90 and through the discharge 86 of the front-valve 80. In the second part of the cycle the pump-tube 10 recovers its original shape, and the suction that it creates moves the front-valve 80 towards the adapter 90 to close the orifices 96 on the adapter 90. When this happens, fluid may only enter from the container 50 through the outlet 51 into the pump-reservoir 12 of the pump-tube 10. The piston 60 moves forward inside the container 50 to compensate for the fluid being dispensed.

CONCLUSION, RAMIFICATIONS, AND SCOPE

Accordingly the reader will see that, according with the invention, I have provided an improved dispenser for dispensing fluids that will stop contaminants from entering the container. This economical solution can be used by persons of almost any age. The fluid-pumping-dispenser has many other advantages in that:

- It permits the fluids to be pumped without difficulty.
- It dispenses a dose, making it ideal for medical applications.
- It is easy and cheap to manufacture, with only a few components, which protects the environment.
- Its components are made of Polypropylene and Polyethylene that are both recyclable and biodegradable.
- It provides a safe way to store special substances (e.g., medicines, anti-aging creams) keeping them safe from contamination.
- It can be injection molded in many color combinations or even be transparent, giving it a unique look.
- Kids and adults are able to use it very quickly, with minimal training.

While the above description contains many specificities, these should not be construed as limitations on the scope of the invention, but as exemplifications of the presently preferred embodiments thereof. Many other ramifications and variations are possible within the teachings of the invention. For example:

- The container and piston can be replaced by a tube or pouch, such as the ones used for everyday products. This eliminates 2 components and uses a technology already being used for many products.
- The dispenser and pump-tube can be made in different materials from the ones specified here.
- The dispenser can be mounted to any variety of containers from the ones indicated here.
- A different container can be used such as a bottle container, connected directly to the fluid-pump-dispenser, or another type of container.
- The housing and actuator can have many different shapes, such as circular, oval, triangular, trapezoidal, etc.
- The pump-tube can have many different cross-section shapes, such as circular, oval, rectangular, etc.
- The components (such as the housing, actuator and container) can be made in more than one color, allowing the product to be customizable to different uses.

Thus the scope of the invention should be determined by the appended claims and their legal equivalents, and not by the examples given.

I claim:

1. A dispenser comprising:

(a) a pump-tube of tubular shape made of flexible material, (b) a plug supported by one or a plurality of ribs inside of said pump-tube, (c) a container having a first end with an outlet and a channel, and with the opposite end of said container to either be open or closed, (d) a housing with a nozzle on a first end, and with a groove on the opposite end of said housing, (e) said pump-tube being attached to said housing by said groove, and also attached to said container by said channel, and with said plug to close or open said container outlet to provide a one way flow to refill said pump-tube.

2. A dispenser comprising:

(a) a pump-tube of tubular shape made of flexible material, (b) a plug supported by a rib or a plurality of ribs inside said pump-tube, (c) a container having a first end with an outlet and a channel, and with the opposite end of said container to either be open or closed, (d) a housing with a nozzle on a first end, and with a groove on the opposite end of said housing, (e) an adapter with one or a plurality of orifices and provided with a shoulder, (f) a front-valve shaped like a disk with a conical discharge exit, (g) said pump-tube being attached to said adapter by said shoulder and installed in said grove of said housing and also attached to said container by said channel, and with said plug to close or open said container outlet to provide a one way flow to refill said pump-tube, and said front valve to be free floating in between said grove of said housing and said adapter to provide a one way valve function by closing or opening said orifices of said adapter when said pump-tube is depressed.

* * * * *